US007178301B2

(12) United States Patent
Albright

(10) Patent No.: US 7,178,301 B2
(45) Date of Patent: Feb. 20, 2007

(54) SIMULATED WOOD ROOFING SHAKE

(76) Inventor: Gary T. Albright, 1350 Industrial Ave., Ste. E., Petaluma, CA (US) 94952

( * ) Notice: Subject to any disclaimer, the term of this patent is extended or adjusted under 35 U.S.C. 154(b) by 419 days.

(21) Appl. No.: 10/695,322

(22) Filed: Oct. 27, 2003

(65) Prior Publication Data

US 2005/0074581 A1 Apr. 7, 2005

Related U.S. Application Data

(60) Provisional application No. 60/421,225, filed on Oct. 25, 2002.

(51) Int. Cl.
*E04D 1/14* (2006.01)
*E04D 1/24* (2006.01)
*E04D 1/34* (2006.01)

(52) U.S. Cl. ..... 52/543; 52/549; 52/551; 52/560; 52/404.1; 52/748.1; D25/139; D25/140

(58) Field of Classification Search ..... 52/544, 52/546, 552, 559, 560, 478.1, 309.7, 309.8, 52/309.16, 551, 748.1, 543, 549; 428/134, 428/136; D25/139, 140
See application file for complete search history.

(56) References Cited

U.S. PATENT DOCUMENTS

| | | | | | |
|---|---|---|---|---|---|
| 1,202,729 | A | * | 10/1916 | Nilsson | 52/543 |
| 1,404,483 | A | * | 1/1922 | Scharwath et al. | 52/560 |
| 1,738,006 | A | * | 12/1929 | Houghton | 52/546 |
| 2,168,218 | A | * | 8/1939 | Kirschbraun | 52/560 |
| 2,276,170 | A | * | 3/1942 | Elmendorf | 52/544 |
| 2,354,639 | A | * | 7/1944 | Seymour | 52/543 |
| 2,447,275 | A | * | 8/1948 | Price | 52/547 |
| 2,510,416 | A | * | 6/1950 | Pretty | 52/533 |
| 2,624,298 | A | * | 1/1953 | Farren | 52/533 |
| 3,848,383 | A | | 11/1974 | Wilson et al. | |
| 3,899,855 | A | * | 8/1975 | Gadsby | 52/90.1 |
| 4,295,314 | A | * | 10/1981 | Ferguson | 52/553 |
| 4,450,663 | A | * | 5/1984 | Watkins | 52/309.4 |
| 4,624,082 | A | * | 11/1986 | Mansfield | 52/11 |
| 5,037,685 | A | * | 8/1991 | Richards et al. | 428/40.5 |
| 5,214,895 | A | * | 6/1993 | Fifield | 52/533 |
| 5,295,339 | A | * | 3/1994 | Manner | 52/518 |
| 5,598,677 | A | | 2/1997 | Rehm, III | |
| 5,630,305 | A | * | 5/1997 | Hlasnicek | 52/518 |
| 5,711,126 | A | * | 1/1998 | Wells | 52/519 |
| 5,791,047 | A | * | 8/1998 | Skalka | 29/897.34 |
| 6,021,611 | A | * | 2/2000 | Wells et al. | 52/98 |
| 6,052,961 | A | * | 4/2000 | Gibbs | 52/518 |
| 6,122,876 | A | * | 9/2000 | Bado et al. | 52/518 |
| 6,892,507 | B1 | * | 5/2005 | Pease | 52/794.1 |
| 6,955,019 | B2 | * | 10/2005 | Donlin et al. | 52/520 |

* cited by examiner

*Primary Examiner*—Robert Canfield
(74) *Attorney, Agent, or Firm*—Craig M. Stainbrook; Stainbrook & Stainbrook, LLP

(57) ABSTRACT

A roof shake which simulates a conventional wooden shake includes an exposure portion, a toplap portion, a headlap portion, a butt end, an upper edge, an upper surface, and a lower surface. The shake tapers from the butt end to the upper edge. The exposure portion of the shake includes at least one cavity which functions as an insulative chamber and may be filled with insulative material. The shake also includes one or more fastener channels through the shake body which allows the shake to be secured to roof sheathing by a fastening strip

21 Claims, 6 Drawing Sheets

SIMULATED WOOD ROOFING SHAKE

CROSS REFERENCE TO RELATED APPLICATIONS

The present application claims the benefit of the filing date of U.S. Provisional Patent Application, Ser. No. 60/421,225, filed 25 Oct. 2002.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to roofing materials, and more particularly to an improved simulated wood roofing shake, preferably molded and fabricated of non-wood materials and having advantageous insulative features and an innovative installation and handling system.

BACKGROUND INFORMATION AND DISCUSSION OF RELATED ART

Wood shakes and roof shingles are conventionally made of cedar, redwood, or cypress, all of which are decay resistant. Roof shakes often provide an aesthetically pleasing shadow effect on the roof and nicely complement shake or other natural wood siding, in part due to the upper surface topography, and in part due to the taper that is unique to handsplit and resawn and tapersplit wood shakes.

However, compared with other commercially available roofing materials, wood shakes have numerous disadvantages. For example, wood shakes provide a fuel for fire. Accordingly, many states have passed laws and implemented building codes that prohibit the use of wood shakes or shingles for roofing. Next, wood shakes are recommended for installation only on roofs having specified pitch and slope minimums. Further still, wood shakes must be installed with spacing between adjacent shakes to allow for expansion of the wood, so as to avoid cupping in the shingle or shake. In addition, throughout their useful life wood shakes and shingles are prone to breakage from heavy loads, such as falling limbs or workmen; and they tend to brittleness and friability near the end of their useful life.

Accordingly, it would be desirable to provide an artificial wood shake that included all of the aesthetically pleasing features of natural wood shakes, but overcame the liabilities. Furthermore, it would be desirable that an artificial wood shake provide increased weather resistance, increased fire resistance, increased wind resistance, and adaptability to various structures and roof layouts.

Numerous products have been proposed to address these and other problems inherent in wood shakes. For example, Goodhart et al. U.S. Pat. No. 5,657,603 discloses a shingle structure made from galvanized mild steel. Fifield U.S. Pat. No. 5,502,940 teaches a composite roofing element with a first layer of aggregate based material, a second layer of material having a lower density, and a wedge shaped region depending from its underside. Wells et al. U.S. Pat. No. 6,021,611 describes a roofing shingle including organic, resinous material and an inorganic filler material, with the appearance of a wooden shake shingle. Rehm, III U.S. Pat. No. 5,598,677 discloses an insulated covering for building sheathing comprising foam insulation, and shaped to accommodate simulated shake roof aluminum roofing panels. Manner U.S. Pat. No. 5,295,339 teaches a simulated shake shingle made from plastic for replicating the random appearance of natural wood shakes. Kemerer U.S. Pat. No. 5,224,318 describes molded exterior building panels formed from thermoplastic material. Waller U.S. Pat. No. 4,932,184 discloses a panel for installation with similar adjacent top, bottom, and side panels to form a roof having the appearance of a wooden shake roof. Sanders et al. U.S. Pat. No. 4,096,011 teaches a method of manufacturing an exterior facing layer for vinyl siding, including molding a pattern of depressions and protuberances into a sheet of a thermoplastic polymer simulating cedar shake shingles. Finally, Wilson et al. U.S. Pat. No. 3.848,383 describes a structural surface metal shingle covering for a wall or roof of a building or the like including a plurality of metal shingle cover elements disposed in parallel courses upon a framework providing a surface.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

The roofing shake of the present invention solves the problems inherent in natural wood shakes, incorporates the desirable features delineated herein, and includes other advantages over other conventional roofing materials as well.

BRIEF SUMMARY OF THE INVENTION

The present invention provides a roof shake which simulates a conventional wooden shake. The inventive shake apparatus includes an exposure portion, a toplap portion, a headlap portion, a butt end, an upper edge, an upper surface, and a lower surface. As with its wooden shake counterpart, the inventive shake tapers from the butt end to the upper edge. However, unique to the inventive apparatus, the exposure portion of the shake includes at least one cavity which functions as an insulative chamber and may be filled with insulative material. Also unique to the present invention, the shake includes one or more fastener channels which allow the shake to be secured to roof sheathing in a novel fashion and without causing any damage to the shake. The inventive shake preferably further includes a number of upper edge tabs to prevent uplift in high winds while simultaneously providing an opening for fasteners from overlapping shakes to pass through and into the roof without causing damage to the underlying shake. Finally, the butt end of the inventive shake preferably includes a novel ledge portion that allows an installer to pick up and manipulate the shake with ease, thereby saving on energy expended in installation and injuries incurred during installation.

It is therefore an object of the present invention to provide a new and improved simulated wood roofing shake.

It is another object of the present invention to provide a new and improved roofing shake incorporating insulative capacity.

A further object or feature of the present invention is a new and improved roofing shake adapted for ease in installation.

An even further object of the present invention is to provide a novel roofing shake that is easy to pick up and manipulate for installation.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein.

DETAILED DESCRIPTION OF THE INVENTION

Figure 1:
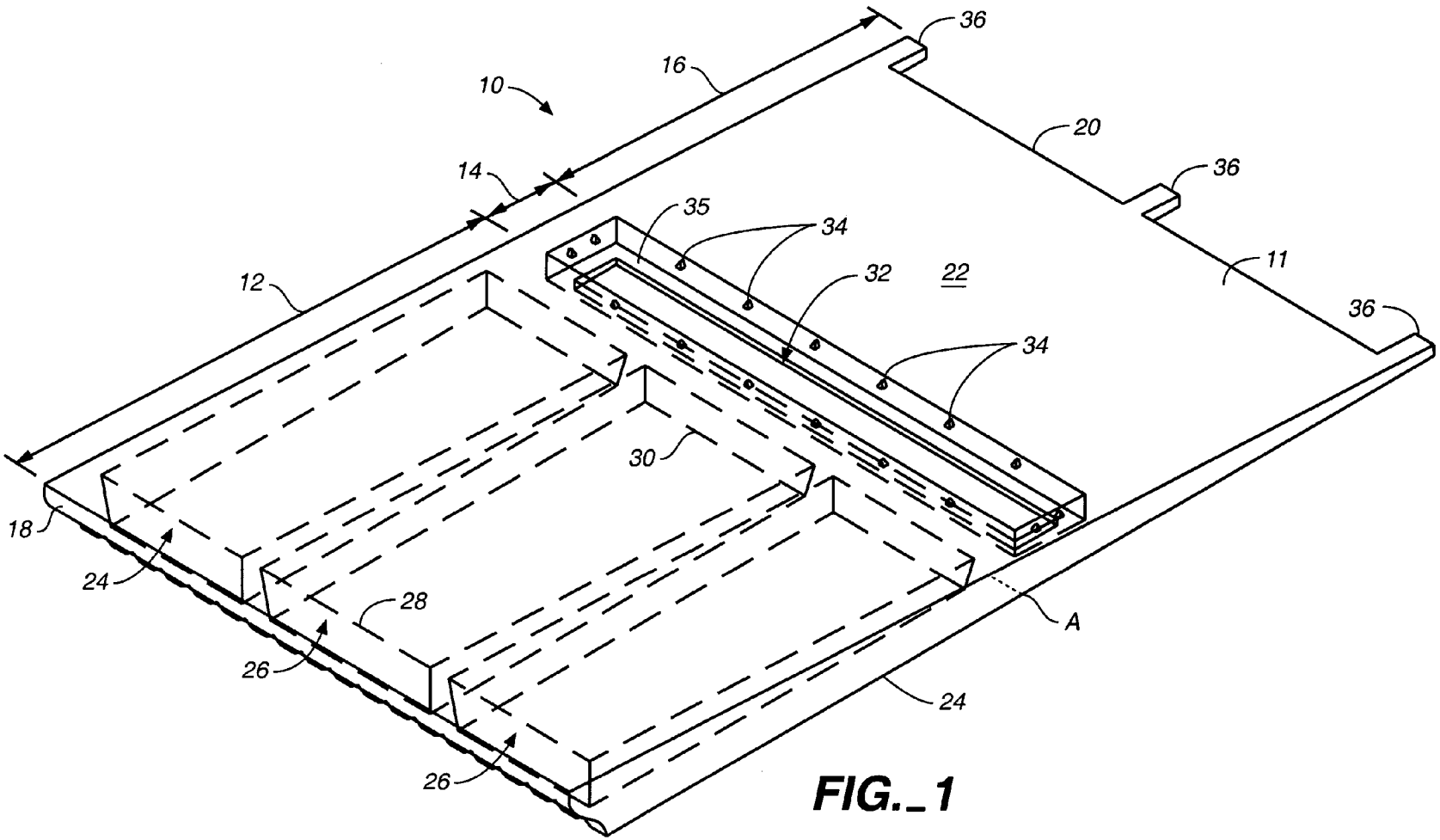
FIG. 1 is a perspective view of the first preferred embodiment of a metal alloy roofing shake of the present invention.

Referring to FIGS. 1 through 7, wherein like reference numerals refer to like components in the various views, there is illustrated therein a new and improved simulated wood roofing shake, generally denominated 10 herein.

The roofing shake of the present invention is embodied in various distinct shakes, some of which are illustrated in FIGS. 1–7, which collectively comprise the elements of a roofing system. While the dimensions of the shakes vary, the general inventive concept is embodied in each system element.

Figure 2:
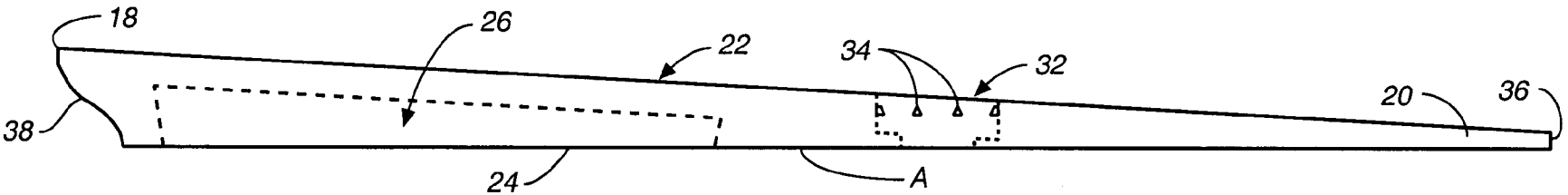
FIG. 2 is a side view in elevation of the shake of FIG. 1.
Figure 3:
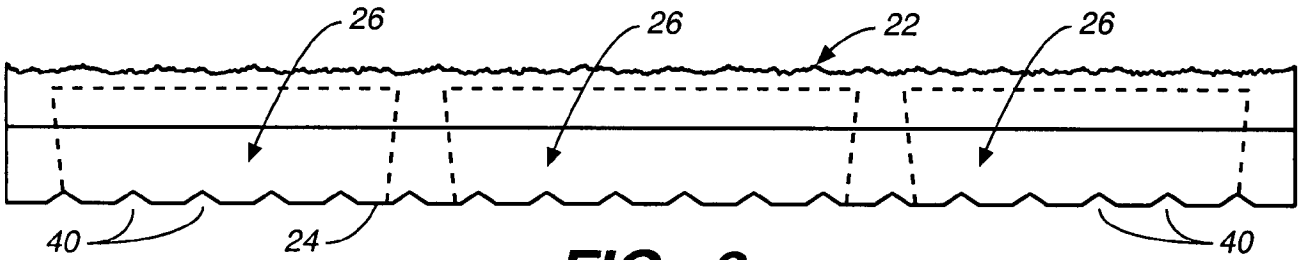
FIG. 3 is a butt end view in elevation of the shake of FIGS. 1 and 2.

FIG. 1 is a perspective view of a first preferred embodiment of the simulated wood roofing shake of the present invention, while FIGS. 2 and 3 are side elevation and end elevation views thereof, respectively. These views collectively show that the inventive shake apparatus, generally denominated 10 herein, has the general profile of a conventional wood shake and includes a body member 11 having an exposure portion 12, a toplap portion 14, a headlap portion 16, a shingle/shake butt end 18, an upper edge 20, an upper surface 22, and a lower surface 24. The shake tapers from the butt end 18 to the upper edge 20 and preferably includes at least one cavity or void 26 having a lower end 28, and an upper end 30, and preferably tapers from the lower end 28 to upper end 30. Each void functions as an insulative chamber that may be left empty or may be filled with insulative material, such as polystyrene or other insulator.

The shake further preferably includes one or more fastener channels 32 extending between the upper surface 22 and the lower surface 24, which provide access for securing the shake to a roof. The channel is preferably generally elongate and adapted to accommodate a block or strip 33 (see FIG. 6) made of wood, plastic, metal, or other material, and sized to fit snugly within the channel 32 and to be captured by a plurality of pointed barbs 34 and supported by channel lip 35. Nails, screws, or other fasteners 37 can be inserted through the block 33 and into the roof sheathing, thereby avoiding potential damage to or braking of the shake itself.

The shake further preferably includes a plurality of upper edge tabs 36 to prevent uplift in windy environments. This also provides an opening for fasteners from overlapping shakes to pass through and into the roof without causing damage to the underlying shake.

Lower surface 24 may not be precisely planar, but rather may include a slight bend along axis A. This bend may serve to reduce gaps between overlapping shakes and the roof sheathing.

As a convenience and to facilitate ease of use and installation, the butt end 18 preferably includes an arcuate ledge 38 (see esp. FIG. 2). This makes it easy for an installer to get his/her fingers under the ledge to pick up and manipulate the shake even after it has been laid on a flat surface.

Referring now to FIG. 3, it will be appreciated that the upper surface 22 includes surface texture or topography that simulates a rough wood shake finish. Lower surface 24 preferably includes a plurality of slots or grooves 40 to channel water and to provide ventilation between the shakes and the roof sheathing.

Figure 4:
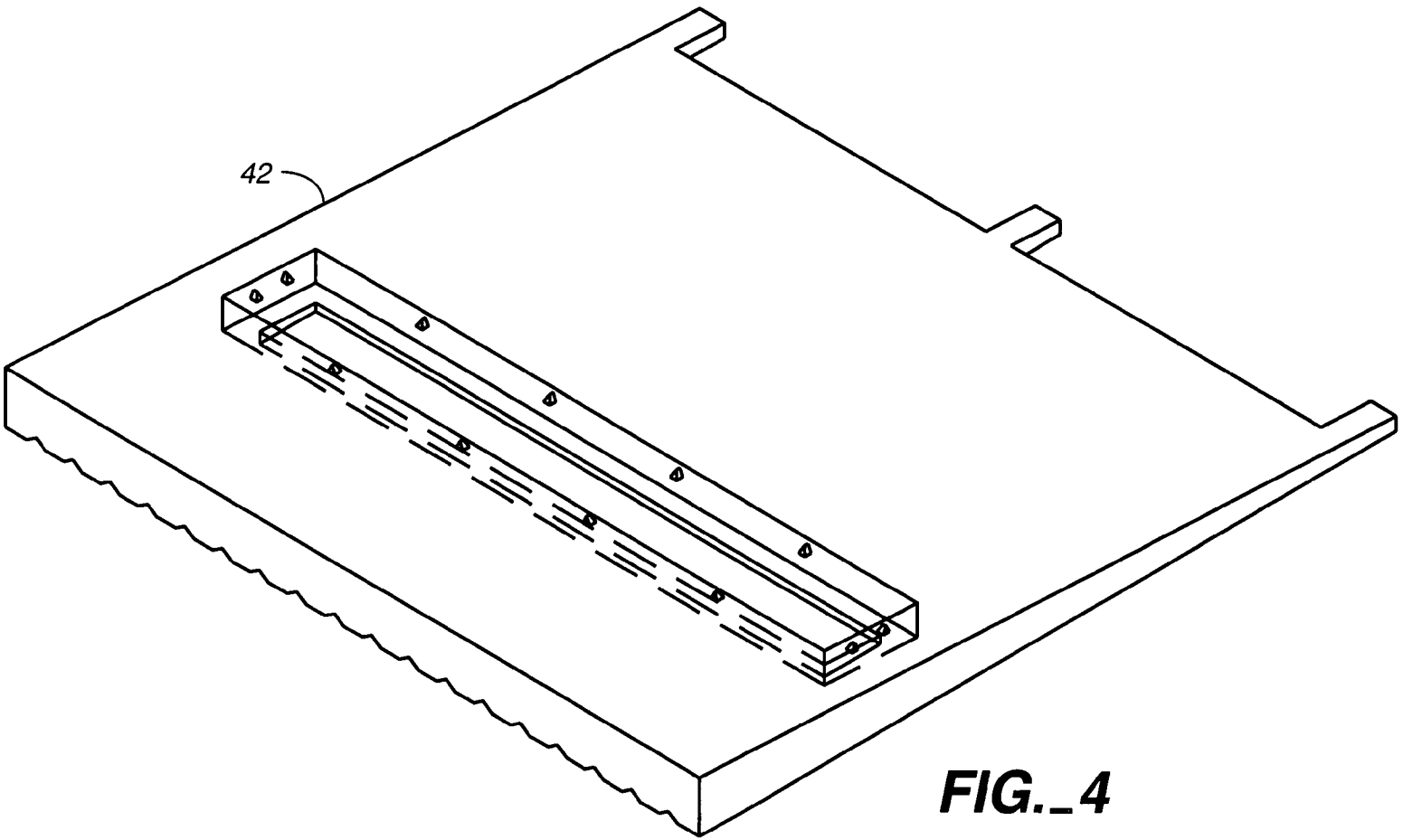
FIG. 4 is a perspective view of an inventive shake adapted for use as a starter shake.

FIG. 4 illustrates an inventive shake adapted for use as a starter shake 42. These and the other shakes in the inventive roofing system may have different physical dimensions (e.g., be more or less elongate, wide, or thick) than other shakes adapted to complete the roofing system. These starter shakes may or may not incorporate a cavity or void, and may or may not include an arcuate ledge on the butt end, but otherwise may incorporate the features of the first preferred embodiment.

Figure 5:
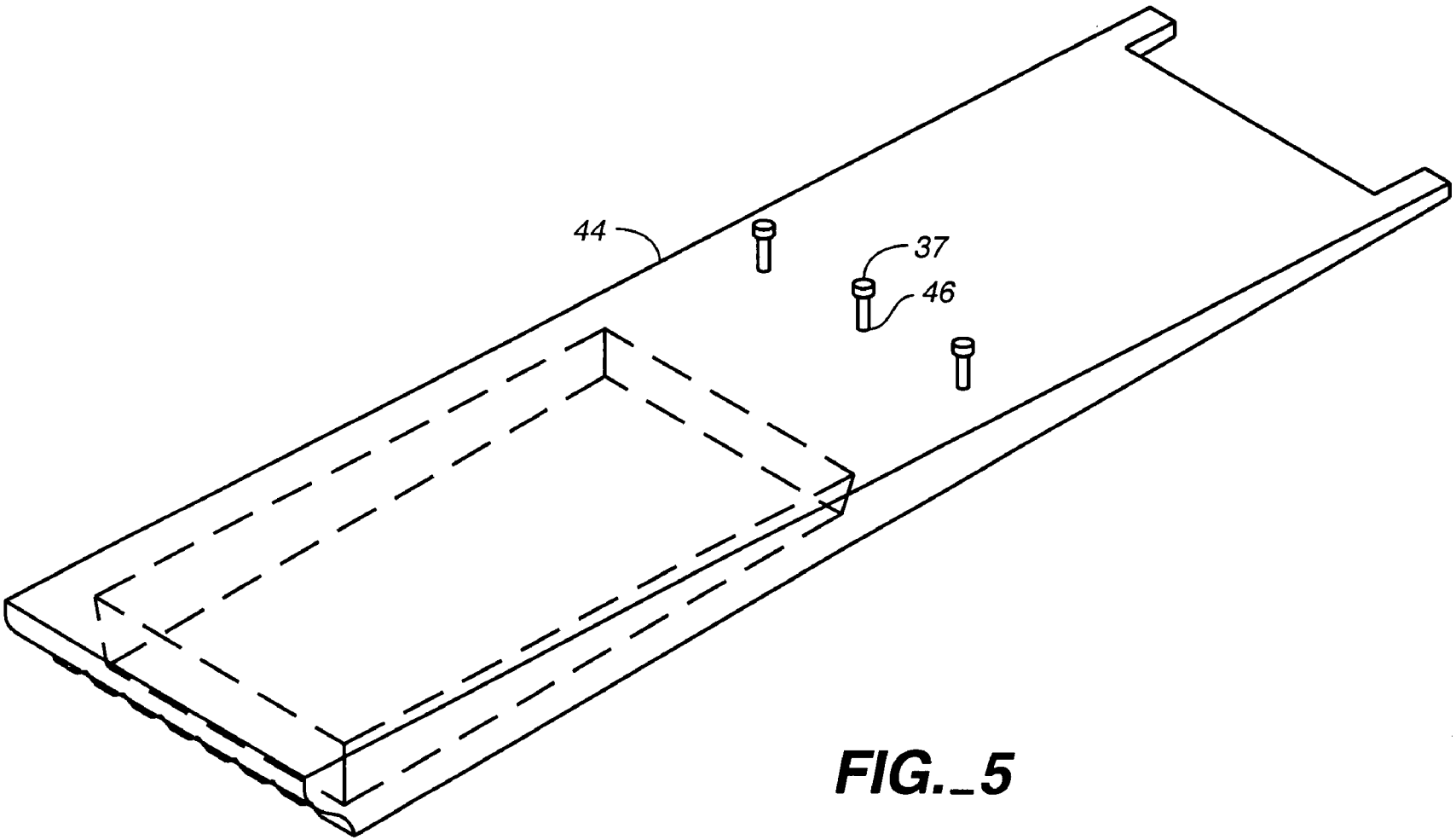
FIG. 5 is a shake adapted for installation along a ridge line.

FIG. 5 illustrates a ridge line shake 44 adapted for installation along a roof ridge line. Here, fasteners 37 penetrate the shake body through fastener holes or apertures 46 and directly into the roof sheathing in the traditional manner, and without the use of a fastening strip. Thus, the ridge line shake(s) overlap and cover the fastener channel and fastening strip of the underlying shake(s).

Figure 6:
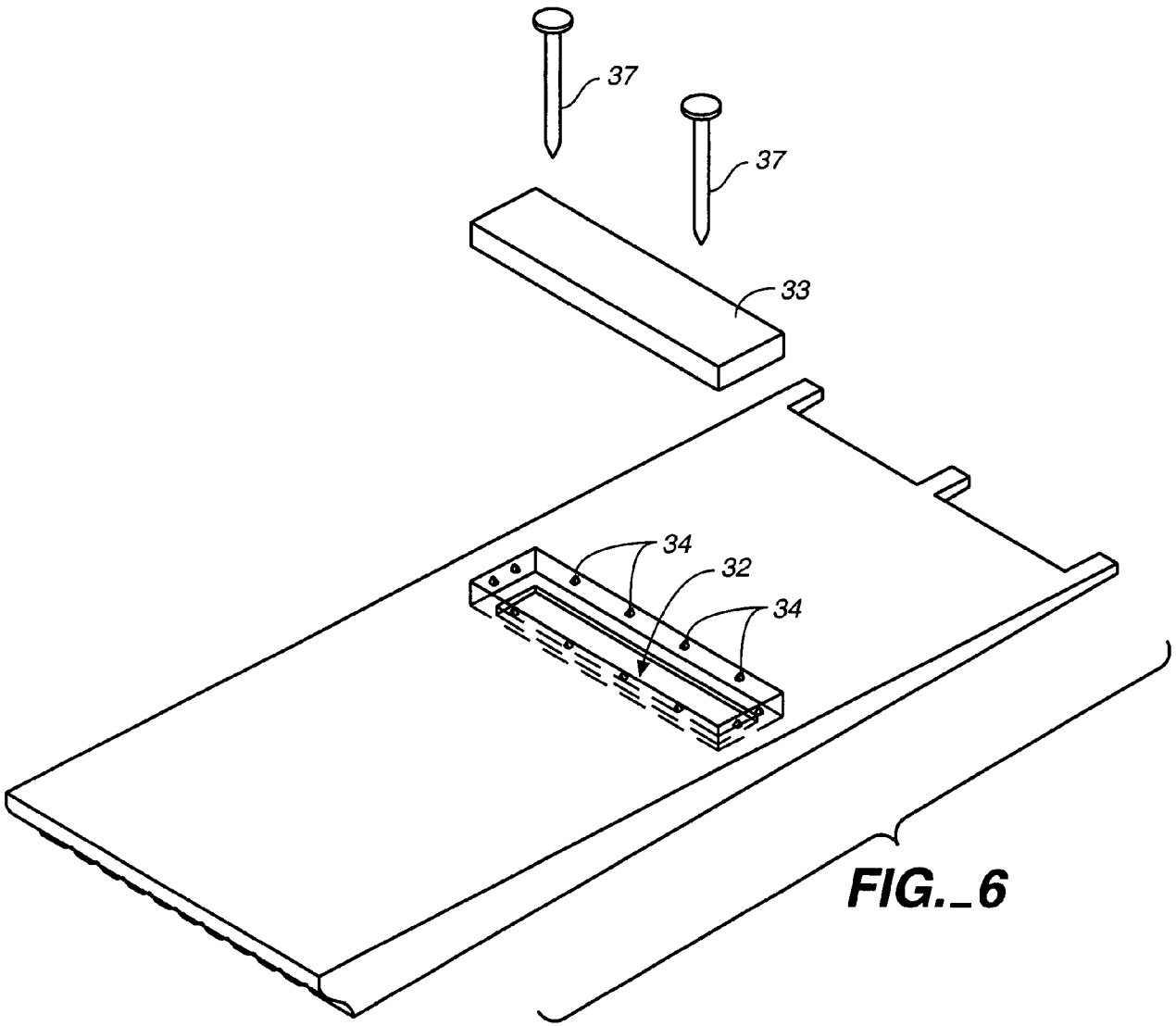
FIG. 6 is an exploded perspective view of a representative shake showing the fasteners and wood strip employed in nailing the shake to a roof.

FIG. 6 is an exploded perspective view of a representative shake showing the method of fastening the shake to a roof. As noted above, channel 32 accommodates a strip 33 of wood or other material and when the strip is pressed into the channel, barbs 34 grip the strip and prevent it from moving. Fasteners 37 such as nails or screws may then be driven through the strip and into the roof sheathing. Thus, regardless of the material from which the shake is made, the shake will not split or otherwise be damaged when attaching it to the roof, and it does not require any tools other than those used in conventional roofing practices.

Figure 7:
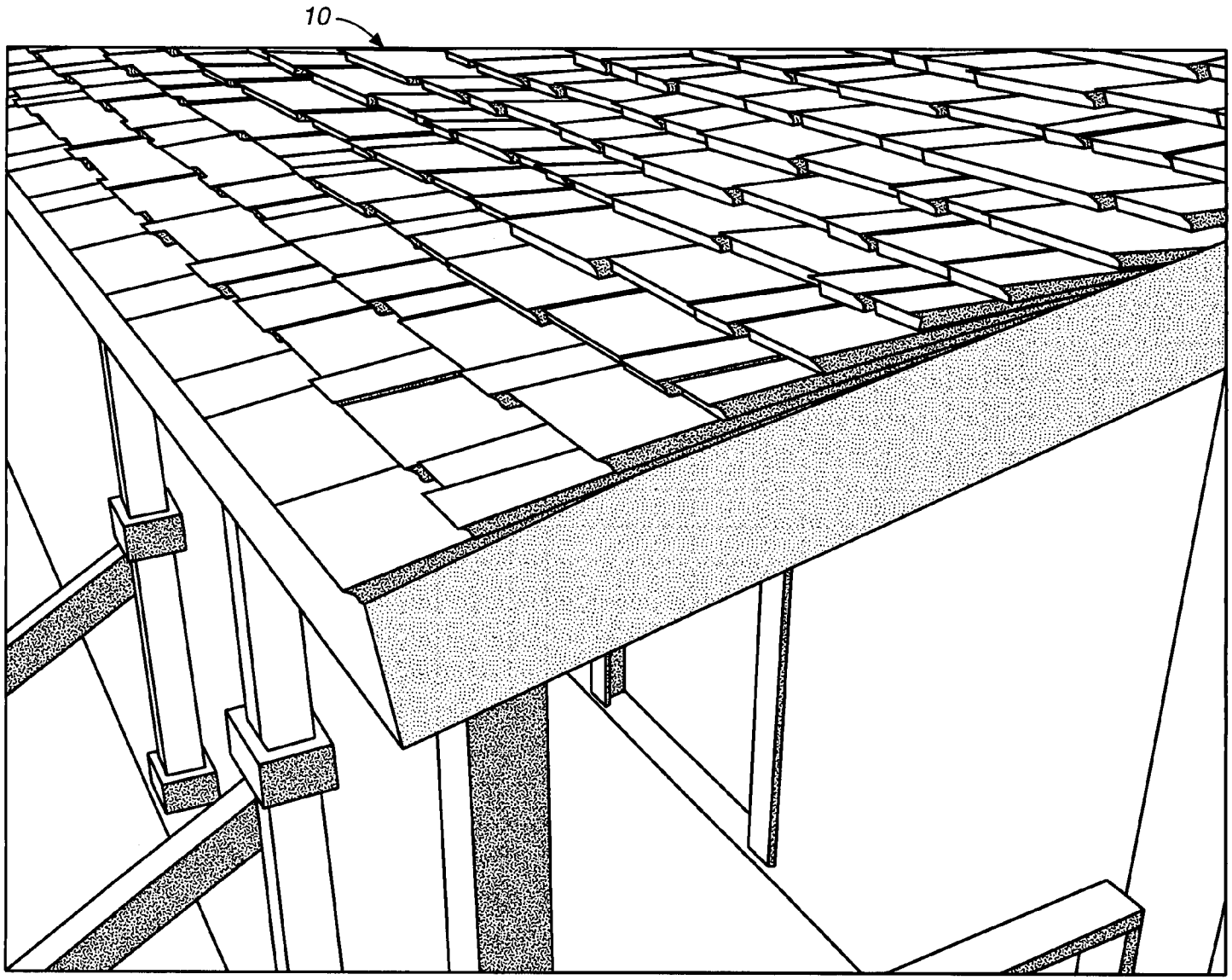
FIG. 7 is a perspective view of a plurality of the inventive shakes in place and as installed on a roof.

FIG. 7 is a perspective view of a plurality of the inventive shakes 10 in place and as installed on a roof. This view illustrates the desired aesthetically pleasing shadow effect on a roof that is achieved with the inventive system.

The inventive shakes may be molded or otherwise fabricated of high grade aluminum alloy. Fabrication using materials other than metals and methods other than molding may be alternatively be applicable or desirable.

The invention may also be characterized by the method of installation, which includes the steps of providing a shake body member having an exposure portion, a toplap portion, a headlap portion, a shake butt, an upper edge, an upper surface, a lower surface, and at least one fastener channel in the shake body member and extending between the upper surface and the lower surface; inserting a strip into the fastener channel; and driving fasteners through the strip and into roof sheathing to secure the shake body to the roof.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A roofing shake, comprising:

a body member having an exposure portion, a toplap portion, a headlap portion, a shake butt, an upper edge, an upper surface, and a lower surface;

a plurality of upper edge tabs to prevent uplift in windy environments; and at least one fastener channel in said body member and extending between said upper surface and said lower surface adapted for installation of a strip through which fasteners may be driven into roof sheathing to secure said shake body to the roof.

2. The roofing shake of claim 1, wherein said body member tapers from said butt end to said upper edge.

3. The roofing shake of claim 1, wherein said exposure portion includes at least one cavity having a lower end and an upper end, said cavity adapted to function as an insulative chamber.

4. The rooting shake of claim 3, wherein said cavity is filled wit insulative material.

5. The roofing shake of claim 4, wherein said insulative material is polystyrene.

6. The roofing shake of claim 3, wherein said cavity tapers from said lower to said upper end.

7. The roofing shake of claim 1, wherein said fastener channel includes a plurality of pointed barbs to capture a fastening strip.

8. The roofing shake of claim 1, wherein said fastener channel includes a lip to support a fastening strip.

9. The roofing shake of claim 1, wherein said upper surface includes surface texture tat simulates a rough wood shake finish.

10. The roofing shake of claim 1, wherein said lower surface includes a plurality of slots to channel water and to provide ventilation between the shakes and the roof sheathing.

11. A roofing shake, comprising:

a body member having an exposure portion, a toplap portion, a headlap portion, a shake butt having an arcuate ledge, an upper edge, an upper surface, and a lower surface; and at least one fastener channel in said body member and extending between said upper surface and said lower surface adapted for installation of a strip through which fasteners may be driven into roof sheathing to secure said shake body to the roof.

12. The roofing shake of claim 11, wherein said body member tapers from said butt end to said upper edge.

13. The roofing shake of claim 11, wherein said exposure portion includes at least one cavity having a lower end and an upper end, said cavity adapted to function as an insulative chamber.

14. The roofing shake of claim 13, wherein said cavity is filled with insulative material.

15. The roofing shake of claim 14, wherein said insulative material is polystyrene.

16. The roofing shake of claim 13, wherein said cavity tapers from said lower to said upper end.

17. The roofing shake of claim 11, wherein said fastener channel includes a plurality of pointed barbs to capture a fastening strip.

18. The roofing shake of claim 11, wherein said fastener channel includes a lip to support a fastening strip.

19. The roofing shake of claim 11, further including a plurality of upper edge tabs to prevent uplift in windy environments.

20. A method of installing a roofing shake, said method comprising the steps of:

providing a shake body member having an exposure portion, a toplap portion, a headlap portion, a shake butt, an upper edge, an upper surface, a lower surface, and at least one fastener channel in the shake body member and extending between the upper surface and the lower surface;

inserting a strip into the fastener channel; and driving fasteners through the strip and into roof sheathing to secure the shake body to the roof;

wherein the shake body member exposure portion includes at least one cavity having a lower end and an upper end, adapted to function as an insulative chamber.

21. The method of claim 20 wherein the cavity is filled with insulative material.

* * * * *